United States Patent [19]

Stumpp et al.

[11] 3,974,811

[45] Aug. 17, 1976

[54] FUEL INJECTION SYSTEM

[75] Inventors: Gerhard Stumpp, Stuttgart; Friedbert Michel, Kornwestheim; Josef Steiner, Esslingen, all of Germany

[73] Assignee: Robert Bosch G.m.b.H., Stuttgart, Germany

[22] Filed: Jan. 3, 1975

[21] Appl. No.: 538,404

[30] Foreign Application Priority Data

Jan. 24, 1974 Germany ..... 2403276

[52] U.S. Cl. ..... 123/139 AW; 123/32 EA; 123/119 R

[51] Int. Cl.² ..... F02M 69/00

[58] Field of Search. 123/119 R, 139 AW, 140 MC, 123/32 EA

[56] References Cited

UNITED STATES PATENTS

| | | | |
|---|---|---|---|
| 3,730,155 | 5/1973 | Knapp | 123/139 AW X |
| 3,791,359 | 2/1974 | Eckert et al. | 123/119 R |
| 3,835,828 | 9/1974 | Knapp | 123/119 R |
| 3,842,813 | 10/1974 | Eckert | 123/119 R |

*Primary Examiner*—Charles J. Myhre
*Assistant Examiner*—Tony Argenbright
*Attorney, Agent, or Firm*—Edwin E. Greigg

[57] ABSTRACT

A fuel injection system for mixture-compressing, externally ignited internal combustion engines of the type employing continuous fuel injection with an induction tube. A measuring member, as well as an arbitrarily actuatable throttle butterfly valve are disposed in sequence within the induction tube. A fuel metering and quantity distribution valve assembly is controlled by the measuring member in proportion to air flow rate. Pressurized fluid, preferably fuel, provides a restoring force for the measuring member, via a control pressure circuit. At least one pressure control valve is provided for controlling the pressure in the control circuit in dependence on motor parameters. A heatable control element, operating in dependence on temperature, forms part of the control valve. The heatable control element, which may be a bimetallic spring, acts in opposition to the force of another spring. Instrumentalities are provided for reducing the pressure of the pressurized fluid in the control pressure circuit during the warm-up phase when the engine is suddenly accelerated.

12 Claims, 7 Drawing Figures

FUEL INJECTION SYSTEM

BACKGROUND OF THE INVENTION

This invention relates to a fuel injection system for mixture-compressing, externally ignited internal combustion engines employing continuous fuel injection into the induction tube of the engine. The present invention relates, more particularly, to such a fuel injection system in which the induction tube contains therein a measuring member, as well as an arbitrarily actuatable throttle butterfly valve, the member and valve being disposed in sequence.

The measuring member in systems of the above-mentioned type moves as a function of the air flow rate through the indution tube and in opposition to a restoring force applied to the measuring member. In its motion, the measuring member sets the movable part of a valve, which is disposed in the fuel line, for metering a fuel quantity in proportion to the air flow rate. The restoring force for the measuring member is produced by pressurized fluid which acts continuously and at constant, but arbitrarily changeable pressure on a control slide which transmits the restoring force. The pressure is supplied through a control pressure circuit. The pressure within the circuit is changed by at least one pressure control valve which is controllable in dependence on motor parameters. The pressure control valve contains a heatable control element operating in dependence on temperature. The heatable control element may be embodied as a bimetallic spring which acts in opposition to the force of a spring within the pressure control valve when the engine operating temperatures are beneath the normal engine operating temperature. The control element is provided with an electric heating element.

The purpose of known fuel injection systems of the type discussed above is to create automatically a favorable fuel-air mixture for all operational conditions of internal combustion engines so as to permit complete fuel combustion, thereby preventing, or at least sharply reducing, the generation of toxic exhaust gases while maintaining the highest possible performance, for the least possible fuel consumption, of the internal combustion engine. In order to achieve this purpose, a fuel quantity which corresponds precisely to the requirement of each operational state of the internal combustion engine must be metered out.

In known fuel injection systems of this type, it is attempted to meter the fuel quantity out as nearly proportional as possible to the air quantity flowing through the induction tube. The ratio of the metered out fuel quantity to the air quantity may be changed by altering the restoring force acting on the measuring member as a function of motor parameters and by means of a pressure control valve.

It has been shown by experiment that during the warm-up phase of operation of an internal combustion engine, the fuel-air mixture may be set to be considerably leaner provided the engine is operating at relatively constant rpm and load, i.e., in steady operation, than if the throttle butterfly valve were opened suddenly.

Consequently, the emission of toxic material and the fuel consumption can both be lowered during the warm-up phase of the internal combustion engine in steady operation, by admitting a leaned out fuel-air mixture and by temporarily enriching the fuel-air mixture during any sudden opening of the throttle butterfly valve.

SUMMARY OF THE INVENTION

It is the principal object of the invention to provide an improved fuel injection system of the known type described above, which permits enriching the fuel-air mixture for a predetermined period of time during the warm-up phase of the internal combustion engine whenever the engine is being accelerated.

The salient characteristic feature of an improved fuel injection system according to the present invention is that pressure of the pressurized fluid in its control pressure circuit may be reduced during the warm-up phase of the internal combustion engine when the engine is suddenly accelerated.

In a preferred embodiment of the present invention, pressure reduction is effected by an electromagnet which engages a valve which can pressure-relieve the control pressure circuit.

In an advantageous variant of the present invention, the electromagnet reduces the effective force of a spring acting on the pressure control valve.

A still further advantageous feature of an embodiment of the present invention provides that a second heatable pressure control valve, operating in temperature-dependent manner, is disposed in the control pressure circuit downstream of the first valve, the second valve being adjusted so as to open at a lower pressure than the first heatable, temperature-dependently operating pressure control valve.

An equally favorable embodiment of the present invention provides that the reduction of the pressure of the pressurized fluid is obtained by enlarging the volume of the control pressure circuit. One end face of a piston, mounted axially slidable in a pressure chamber, may be exposed to the pressurized fluid of the control pressure circuit, and the other end face of the same piston may be exposed to the pressurized fluid within a relief circuit. The axial displacement of the piston may be limited by means of stops. An electromagnet is provided for opening a valve through which the pressure in the relief circuit can be reduced, and when the valve is closed, the force acting on that face of the piston nearest to the control pressure circuit is less than the force acting on the opposite end face. The control pressure circuit and the relief circuit are connected by two throttles and a check valve.

Yet another preferred embodiment of the present invention provides that the interior volume of a diaphragm bellows communicates with the control pressure circuit, one end face of the diaphragm bellows being affixed to the housing of a pressure-sensitive jar. The other end face of the diaphragm bellows is connected to a diaphragm which separates a first chamber from a second chamber within the pressure-sensitive jar. The two chambers communicate via a throttle aperture, and an air line causes the first chamber to experience the same pressure prevailing in the induction tube downstream of the throttle butterfly valve. The air line contains a valve, which has a movable valve member embodied as an electrically heatable, bimetallic spring by means of which the air line may be closed, after the warm-up phase of the internal combustion engine is terminated.

A further preferred feature of the present invention is that the pressurized fluid is fuel.

The invention can be better understood, and further objects, features and advantages are to become more apparent from the ensuing detailed description of the preferred, although exemplary embodiments and variants, taken in conjunction with the seven figures of the drawing.

DESCRIPTION OF THE PREFERRED EMBODIMENTS

Figure 1:
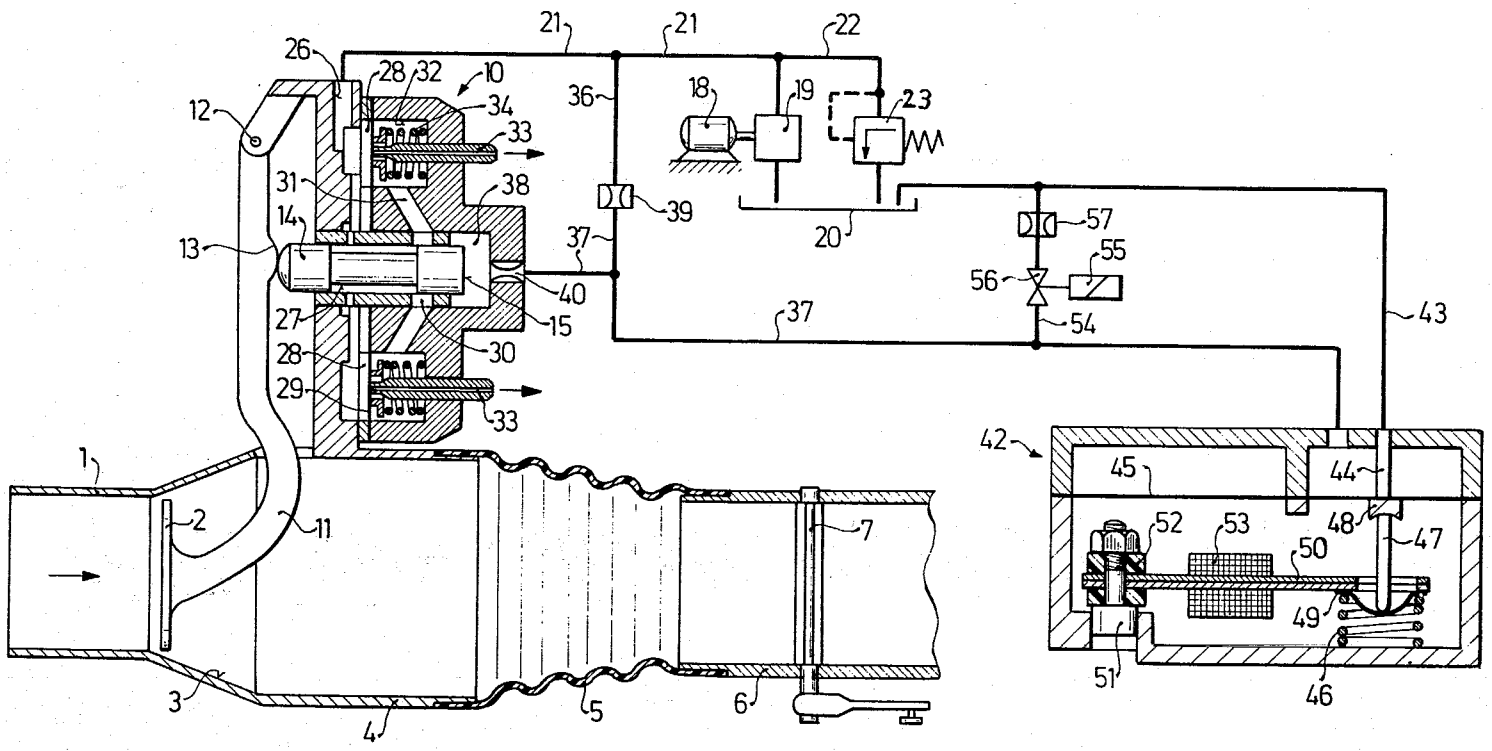
FIG. 1 is a sectional, front-elevational, partially schematic diagram of a first embodiment of a fuel injection system according to an exemplary embodiment of the present invention.

In the illustrative embodiment of the fuel injection system according to the present invention shown in FIG. 1, combustion air flows in the direction of an arrowheaded line through an induction tube region 1 containing a measuring member 2 positioned within a conical portion 3 of the induction tube. The air then flows through an induction tube region 4 and thence through a connecting hose 5 into an induction tube region 6 containing an arbitrarily actuatable throttle butterfly valve 7. Beyond the butterfly valve 7, the air flows onto one or several cylinders (not shown) forming part of an internal combustion engine. The measuring member 2 is embodied as a plate disposed transverse to the direction of the air flow and moves within the conical portion 3 of the induction tube according to an approximately linear function of the air quantity flowing through the induction tube. When the restoring force acting on the measuring member 2 is constant, and when the air pressure prevailing ahead of the measuring member 2 is also constant, then the pressure prevailing between the measuring member 2 and the throttle butterfly valve 7 is constant as well.

The measuring member 2 immediately controls a metering and quantity distribution valve assembly 10. A lever 11 serves to transmit the motions of the measuring member 2 by pivoting about a point 12 and by actuating, during its pivotal motions and by means of a projection 13, a movable valve member 14 forming part of the metering and quantity distribution valve assembly 10. As illustrated, the valve member 14 is embodied as a control slide. An end face 15 of the control slide 14 facing away from the projection 13 is exposed to a pressurized fluid whose pressure is exerted on the end face 15 thereby producing the restoring force for the measuring member 2.

Fuel is supplied by a fuel pump 19 driven by an electric motor 18 which aspirates fuel from a fuel container 20 and delivers it via a fuel supply line 21 to the fuel metering and quantity distribution valve assembly 10. Branching off from the fuel supply line 21 is a line 22 containing a pressure limiting valve 23 which permits fuel to flow back into the fuel container 20 when the system pressure becomes too great.

Fuel flows from the fuel supply line 21 into a channel 26 within the housing of the metering and quantity distribution valve assembly 10. The channel 26 leads to an annular groove 27 in the control slide 14 and thence through several branchings to chambers 28 so that one side of a diaphragm 29 is subjected to the fuel pressure. Depending on the position of the control slide 14, the annular groove 27, more or less, opens control slits 30 each of which lead through a respective channel 31 to a respective chamber 32 which is separated by the diaphragm 29 from the respective chamber 28. From the chambers 32, fuel flows through injection channels 33 to the individual injection valves (not shown), located in the vicinity of the cylinders of the engine within the induction tube. The diaphragm 29 serves as the movable member of a flat seat valve which is held open by a spring 34 when the fuel injection system is not in operation. The diaphragm jars, each of which is formed by a respective chamber 28 and a respective chamber 32 have the effect that the pressure gradient across the annular groove 27 and the control slits of the valve assembly 30 remains substantially constant, independently of the overlap occurring as between the annular groove 27 and the control slits 30 and also independently of the amount of fuel flowing to the injection valves. This guarantees that the setting path of the control slide 14 and the metered-out fuel quantity are proportional to one another.

In operation, during pivotal motion of the lever 11, the measuring member 2 is moved into the conical region 3 of the induction tube so that the changing annular cross section between the measuring member 2 and the conical wall remains proportional to the setting path of the measuring member 2. The pressurized fluid which produces the constant restoring force for the control slide 14 is fuel. For this purpose, a line 36 branches off from the fuel supply line 21 and leads through a control pressure line 37 into a pressure chamber 38 into which the end face 15 of the control slide 14 extends. The control pressure circuit 37 is separated from the supply circuit leading to the metering and quantity distribution valve assembly 10 by a pre-throttle 39. The pressure exerted in pressure chamber 38 is damped by a damping throttle 40.

The control pressure circuit 37 contains a pressure control valve 42 through which the pressurized fluid fuel can return without pressure to the fuel container 20 via a return line 43. The pressure control valve 42 permits a temperature-dependent control of the pressure in the pressurized fluid which provides the restoring force. The pressure control valve 42 is embodied as a flat seat valve having a fixed valve seat 44 and a diaphragm 45 which is loaded by a spring 46 in the direction of the closure of the pressure control valve 42. The closing force exerted by the spring 46 is transmitted by a pin 47 held by a bearing surface 48 and a spring support cup 49 positioned between the diaphragm 45 and the spring 46. When temperatures are below the operational temperature of the engine, the force of the spring 46 is opposed by a bimetallic spring 50 acting on the spring support cup 49. The other end of the bimetallic spring 50 is threadedly clamped to a bolt 51 pressed into the housing of the pressure control valve 42. The bimetallic spring 50 is protected against heat loss due to heat conduction to the housing of the pressure control valve 42 by an insulating member 52 located between the bolt 51 and the bimetallic spring 50. An electric heating element 53 is mounted on the bimetallic spring 50.

Branching off from the control pressure circuit 37 is a line 54 containing a valve 56 actuatable by an electromagnet 55. A throttle 57 is disposed downstream of the valve 56 and, when the valve 56 is open, the control pressure circuit 37 can be pressure-relieved through the throttle 57 leading to the fuel container 20.

Figure 2:
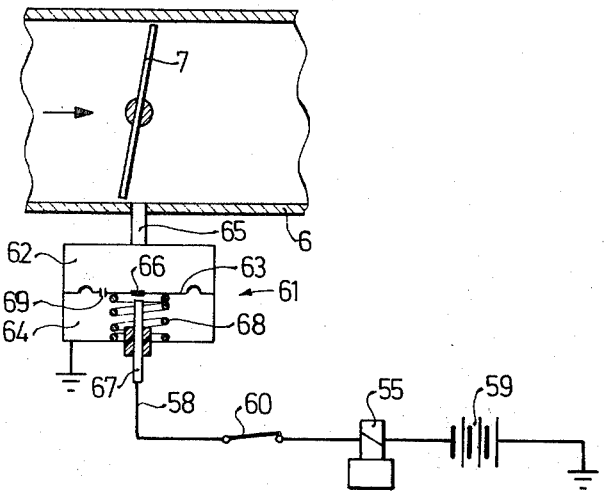
FIG. 2 is a partially schematic diagram of a mechanism for sensing the pressure in an induction tube downstream from the throttle butterfly valve positioned therein.

The electromagnet 55 is located in an electric circuit 58 such as is represented in FIG. 2, for example. The electrical circuit 58 is powered by a current source 59 and can be interrupted by a temperature sensitive switch 60 and a setting motor or servo-assembly 61. The temperature switch 60 can also be embodied as a thermal time switch which limits the duration of operation of the electromagnet 55 and hence limits the mixture enrichment depending on the engine temperature. The servo-assembly 61 includes a first chamber 62, which is separated by a diaphragm 63 from a second chamber 64. The first chamber 62 is in communication with the second chamber 64 through a throttle 69, and it communicates with the induction tube downstream of the throttle butterfly valve 7 via an air line 65. The diaphragm 63 is connected with an electrical contact 66 which cooperates with an electrically insulating manner within the second chamber 64. The second chamber 64 also contains a spring 68 which acts on the diaphragm 63 in the direction of separating the electrical contact 66 from the electrical contact 67.

The actuation of the servo-assembly 61 can also take place, for example, depending on a change of the position of the throttle butterfly valve 7 or on a change in the air pressure difference across the measuring member 2.

The operation of the fuel injection system shown in FIG. 1 is set out below.

When the internal combustion engine is in operation, the fuel pump 19, powered by the electric motor 18, aspirates fuel out of the fuel container 20 and delivers it through the fuel supply line 21 to the fuel metering and quantity distribution valve assembly 10. At the same time, the internal combustion engine aspirates air through the induction tube and, as a consequence, the measuring member 2 is diviated somewhat from its quiescent position. Corresponding to the deviation of the measuring member 2, the lever 11 moves the control slide 14, which opens a corresponding larger cross section of the control slits 30. The direct connection between the measuring member 2 and the control slide 14 results in a constant ratio of the air quantity to the metered-out fuel quantity provided that the operating characteristics of these two elements are sufficiently linear, this being the design criteria for these elements. As described thus far, the fuel-air ratio would be constant over the entire operational domain of the engine. However, it is necessary to make the fuel-air mixture richer or leaner depending on the operational conditions of the internal combustion engine. This may be done by changing the restoring force acting on the measuring member 2. For this purpose, the control pressure circuit 37 contains the pressure control valve 42 which changes the pressure of the pressurized fluid during the warm-up phase of the internal combustion engine and thus influences the mixture enrichment in a temperature-dependent manner until the operational temperature of the engine is reached. The control pressure is determined by the closing force of the spring 46 transmitted by the pin 47 to the diaphragm 45. When the temperatures are below the operating temperature of the internal combustion engine, however, the bimetallic spring 50 acts on the spring support cup 49 in opposition to the spring 46, with the effect that the closing force transmitted to the diaphragm 45 is reduced. However, immediately after starting, the electric heater 53 heats up the bimetallic spring 50 and, as a consequence, the force exerted by the bimetallic spring 50 on the spring support cup 49 is also reduced. The desired basic tension setting of the bimetallic spring 50 can be obtained simply by pressing the bolt 51 into the housing of the pressure control valve 42 to a variable, predetermined depth.

Figure 3:
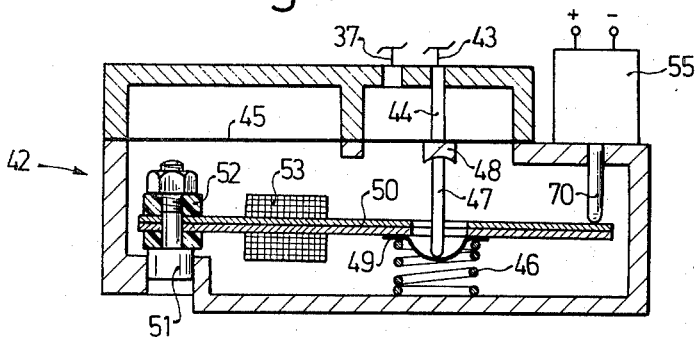
FIG. 3 is a sectional, elevational view depicting a first version of a pressure control valve usable in fuel injection systems embodied according to the present invention.

Thus, when the internal combustion engine is suddenly accelerated during its warm-up phase, in order to provide in addition to the fuel quantity metered out by the metering and quantity distribution valve assembly 10 in dependence on the aspirated air quantity, an additional acceleration fuel quantity, so as to produce a richer fuel-air mixture, then, according to the present invention, the pressure of the pressurized fuel in the control pressure circuit 37 is reduced. A reduction of the pressure of the pressure fluid in the control pressure circuit 37 reduces the restoring force acting on the measuring member 2 so that, even though the air quantity flowing past the measuring member 2 remains the same, there is a greater excursion of the measuring member 2 and hence of the control slide 14 which, in turn, increases the fuel quantity metered out by the annular groove 27 and the control slits 30 of the metering valve assembly 10. The reduction of the pressure of the pressurized fluid in the pressure control circuit 37 is produced by the servo-assembly 61 (FIG. 2), which closes the electrical circuit 58 during a sudden acceleration of the internal combustion engine, so that the electromagnet 55 is energized and opens the valve 56, with the result that pressurized fluid can flow from the control pressure circuit 37 through the throttle 57 back to the fuel container 20. During a sudden acceleration, the reduction of the pressure of the pressurized fluid can also occur in that the electromagnet 55 acts on the bimetallic spring 50 of the pressure control valve 42 via an actuating pin 70 in the direction of reducing the closure force exerted by the spring 46 in the pressure control valve 42 (FIG. 3).

Figure 4:
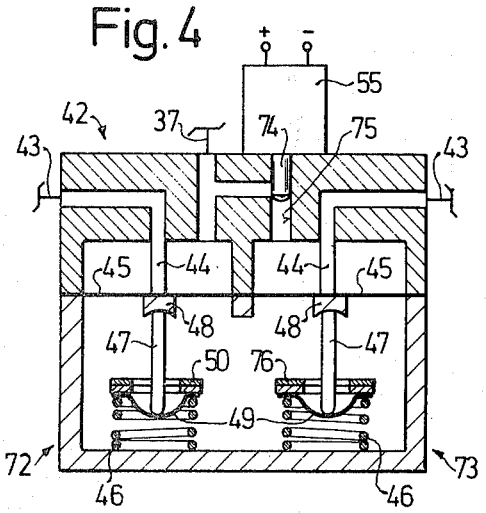
FIG. 4 is a sectional, elevational view depicting a second version of a pressure control valve usable in fuel injection systems embodied according to the present invention.

FIG. 4 shows a pressure control valve 42 containing a first temperature-dependently operating, heatable pressure control valve 72 and a second temperature-dependently operating, heatable pressure control valve 73. During a sudden acceleration of the internal combustion engine, the electromagnet 55 acts via a valve member 74 to open a connecting channel 75 leading from the control pressure circuit 37 to the second temperature-dependently operating pressure control valve 73. The closing force of the second temperature-dependently operating pressure control valve 73 is chosen to be lower than the closing force of the first temperature-dependently operating pressure control valve 72. This means that when the connection channel 75 is opened, the second temperature-dependently operating pressure control valve 73 provides a lower pressure in the control pressure circuit 37 than is the case when the connecting channel 75 is closed. The bimetallic spring 76 in the second temperature-dependently operating pressure control valve 73 can be heated, for example, by engine cooling water. The provision of the second temperature-dependently operating pressure control valve 73 offers the advantage that the control pressure in the control pressure circuit can be lowered, for the purpose of an enrichment during engine acceleration, to a pressure level which is variable.

Figure 5:
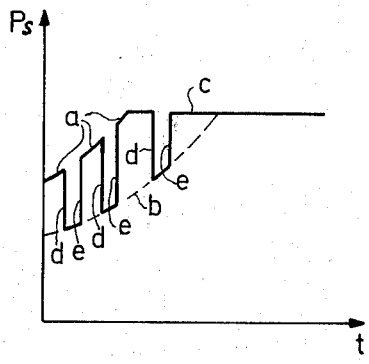
FIG. 5 is a graphic diagram showing the time behavior of the control pressure of the pressure fluid in fuel injection systems according to the present invention.

The time behavior of the control pressure in the control pressure circuit 37 during the warm-up phase of the engine is represented, by way of example, in the graphic diagram of FIG. 5 wherein $P_s$ is the control pressure and $t$ is the time. The curve $a$ in this figure represents the time behavior of the control pressure as regulated by the first temperature-dependently operating pressure control valve 72 and the line $b$ shows the time behavior of the control pressure as it would be regulated by the second temperature-dependently operating pressure control valve 73. The horizontal line $c$ represents the valve of the control pressure after termination of the warm-up phase of the internal combustion engine. When the engine is suddenly accelerated, the electromagnet 55 opens the connection channel 75, and the control pressure in the control pressure circuit drops from the pressure indicated by the curve $a$ along the curve portion $d$ to the pressure on curve $b$. After the enrichment for purposes of acceleration is finished, the pressure rises from the pressure corresponding to line $b$ along the curve portion $e$ to the pressure indicated by the curve $a$ or the line $c$, as the case may be.

Figure 6:
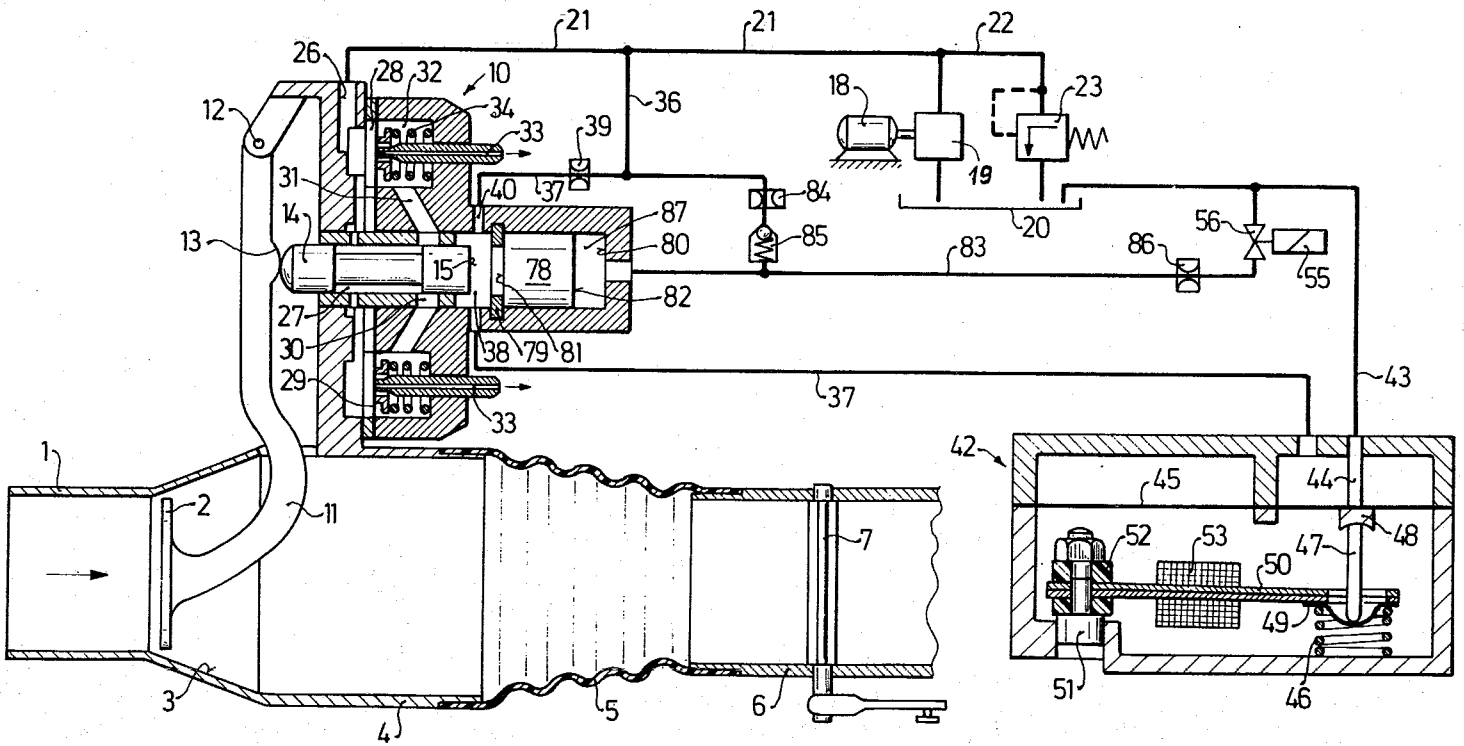
FIG. 6 is a sectional, front-elevational, partially schematic diagram of a second embodiment of a fuel injection system according to a further exemplary embodiment of the present invention.

In FIG. 6, as in previous figures, elements which are identical to those in FIG. 1 are provided with the same reference numerals used in FIG. 1. The fuel injection system according to the present invention shown in FIG. 6 accomplishes the reduction of the control pressure in the control pressure circuit by enlarging the volume of the control pressure circuit 37 itself. For this purpose, the pressure chamber 38 of the metering and quantity distribution valve assembly 10 contains a piston 78 mounted axially slidable between stops 79 and 80. One end face 81 of the piston 78 adjacent to the end face 15 of the control slide 14 is exposed to the pressure of the pressure fluid in the control pressure circuit 37 and its end face 82, facing away from the control slide 14, is exposed to pressure of the pressure fluid in a relief circuit 83. A throttle 84 and a check valve 85 uncouple the pressure relief circuit 83 from the line 36 of the fuel supply circuit 21 in such a way that the pressure within the relief circuit 83 is higher than that in the control pressure circuit 37. The pressure in the relief circuit 83 may be reduced by a relief throttle 86 and by the valve 56, actuated by the electromagnet 55, the valve 56 being located downstream of the relief throttle 86. When the valve 56 is closed, the pressure of the pressure fluid in the relief circuit 83 is higher than the pressure of the pressurized fluid in the control pressure circuit 37 so that the piston 78 is moved into a position wherein it abuts the stop 79. When the internal combustion engine is accelerated and the valve 56 is opened by the electromagnet 55, the pressure of the pressurized fluid in the relief circuit 83 drops below that in the control pressure circuit 37 and the piston 78 is displaced in the direction toward the stop 80. The duration of the fuel mixture enrichment process for purposes of acceleration depends on the volume of the space 87, on the size of the damping throttle 40 and on the control pressure and hence has a maximum limitation. A check valve 85 prevents a sliding motion of the piston 78 when the engine is accelerated in its warmed-up operational condition.

Figure 7:
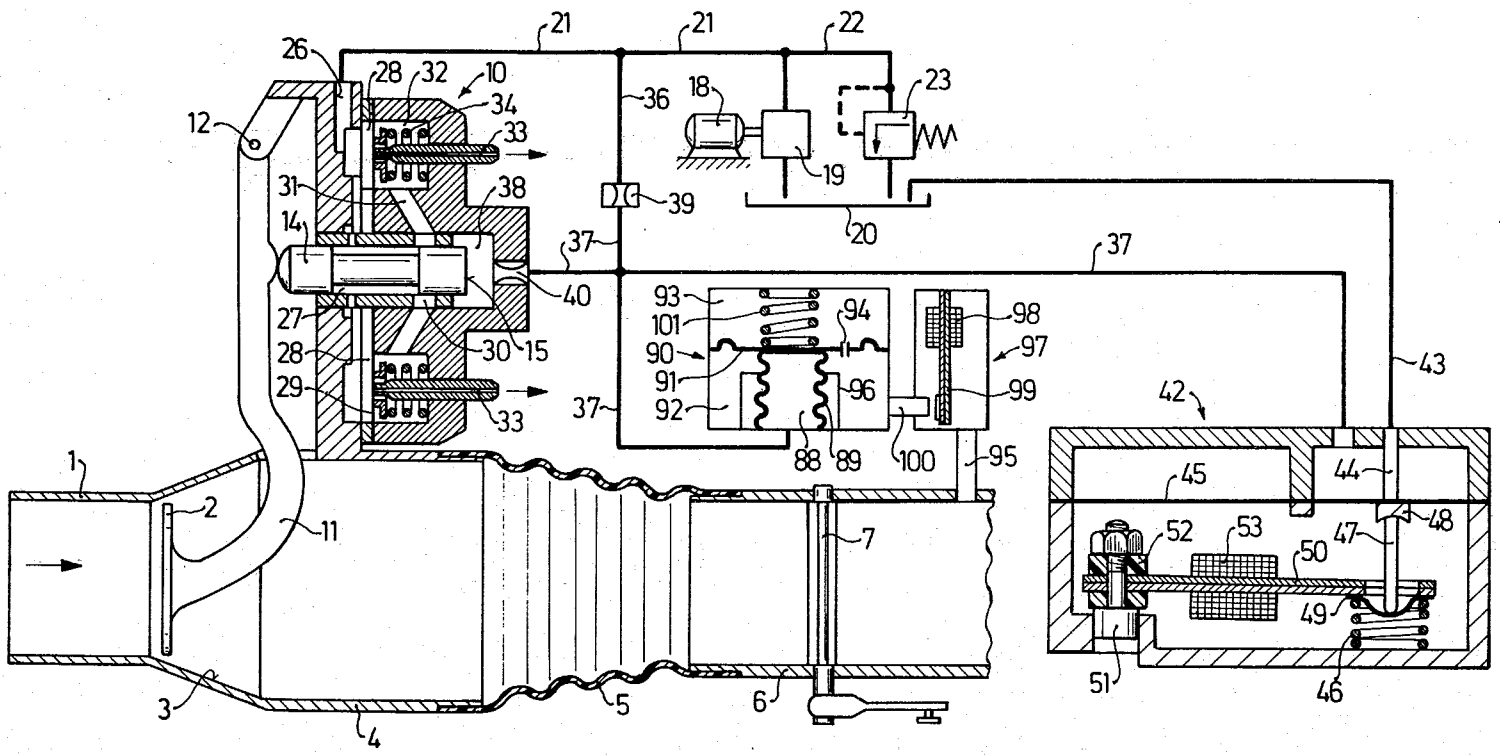
FIG. 7 is a sectional, front-elevational, partially schematic diagram of a third fuel injection system embodied according to an additional exemplary embodiment of the present invention.

Another possibility for enlarging the volume of the control pressure circuit is shown in FIG. 7. Those elements shown in FIG. 7 which correspond to those in FIG. 1 and other preceding figures are provided with the same reference numerals. As shown in FIG. 7, the interior volume 88 of a diaphragm bellows 89 is connected to the control pressure circuit 37 and one face of the diaphragm bellows 89 is connected to the housing of a pressure jar 90, whereas, its other face is connected to a diaphragm 91 which separates a first chamber 92 of the pressure jar 90 from a second chamber 93. The chambers 92, 93 are connected to one another via a throttling aperture 94. The first chamber 92 is provided, via an air line 95, with the induction tube pressure prevailing downstream of the throttle butterfly valve 7. The motion of the diaphragm 91 is limited by a stop 96. The air line 95 contains a valve 97 whose movable valve member is a bimetallic spring 99, heatable by an electric heating element 98, and after the termination of the warm-up phase of the internal combustion engine, this bimetallic spring 99 moves toward a valve seat 100 and thus interrupts the air connection to the pressure jar 90. During a sudden opening of the throttle butterfly valve 7 during the warm-up phase of the internal combustion engine, the pressure in the first chamber 92 of the pressure jar 90 is increased through the air line 95, which moves the diaphragm 91 in the direction of enlarging the first chamber 92 in opposition to the force of a spring 101. At the same time, the diaphragm bellows 89 connected to the diaphragm 91 moves in the direction of enlarging its interior volume 88 so that the control pressure circuit 37 experiences a sudden drop of the pressure of the pressurized fluid, and the reduction of the restoring force acting on the measuring member 2 moves the control slide 14 in the direction of a further opening of the control slits 30. The acceleration-induced fuel enrichment is limited by the pressure equalization taking place between the first chamber 92 and the second chamber 93 through the throttle aperture 94. It is possible to replace the diaphragm bellows 89 by a piston connected with the diaphragm 91 which would move axially slidable in a cylindrical bore connected to the control pressure circuit 37. Since, after the start of the internal combustion engine, the bimetallic spring 99 continuously moves closer to the valve seat 100, there is a continuous reduction of the cross section of the air line 95 and, hence, a decrease of the response sensitivity. This behavior is desirable in order that, when the internal combustion engine is cold and the acceleration takes place directly after the start, the fuel-air mixture is enriched even for a very small pressure increase; whereas, when the internal combustion engine is somewhat warmer, the triggering of the enrichment process takes place only when the pressure increases is somewhat greater.

It is to be appreciated that the foregoing description and accompanying drawing illustrations are provided by way of example and not by way of limitation. Moreover other embodiments and variants are possible within the spirit and scope of the invention, its scope being defined by the appended claims.

What is claimed is:

1. A fuel injection system for mixture-compressing externally ignited internal combustion engines employing continuous fuel injections comprising, in combinations:

a. an induction tube into which fuel is to be continuously injected;

b. a measuring member positioned within said induction tube for moving as a function of the air flow rate therein;

c. an arbitrarily actuable, throttle butterfly valve disposed within said induction tube, said measuring member and said butterfly fly being disposed sequentially;

d. a fuel metering and quantity distribution valve assembly including a fuel passage, a movable part disposed in the fuel passage, said valve assembly being coupled to said measuring member and controlled thereby for metering out a fuel quantity in proportion to the air flow rate in said induction tube;

e. means for providing a restoring force, which acts in opposition to the force provided by the air flow in the induction tube, to said measuring member including:

1. at least one pressure control valve controllable in dependence on at least one engine operating parameter;

2. a control pressure circuit having said control valve therein;

3. means for supplying pressurized fluid to said control pressure circuit; and 4. a control slide formed by the movable part of the fuel metering and quantity distribution valve assembly, said control slide being acted upon by the fluid in said control pressure circuit coupled to said measuring member for transmitting the restoring force thereto;

f. at least one movable heatable control element operable in dependence on temperature and at least one spring forming part of said at least one pressure control valve, said control element acting in opposition to the force of said spring when at least one operating temperature of the engine is below normal running temperature;

g. an electrical heating means for heating said control element;

h. valve means coupled to said pressure control circuit and responsive to movement of said butterfly valve for reducing the pressure of the pressurized fluid in said control circuit during engine warm-up phase when the engine is suddenly accelerated; and i. an electromagnet provided for controlling the valve means.

2. A fuel injection system according to claim 1, wherein said means for reducing the pressure includes spring means, said electromagnet being arranged to reduce the force of said spring means on said valve means.

3. A fuel injection system according to claim 1, further comprising a second control valve including a second, heatable control element operable in dependence on temperature, said second control valve being positioned in said control pressure circuit downstream from said at least one control valve and openable at a lower pressure than said at least one control valve.

4. A fuel injection system according to claim 1, wherein said means for supplying pressurized fluid to said control pressure circuit is a means for supplying pressurized fuel to said control pressure circuit as the pressurized fluid.

5. A fuel injection system for mixture-compressing externally ignited internal combustion engines employing continuous fuel injections comprising, in combinations:

a. an induction tube into which fuel is to be continuously injected;

b. a measuring member positioned within said induction tube for moving as a function of the air flow rate therein;

c. an arbitrarily actuable, throttle butterfly valve disposed within said induction tube, said measuring member and said butterfly fly being disposed sequentially;

d. a fuel metering and quantity distribution valve assembly including a fuel passage, a movable part disposed in the fuel passage, said valve assembly being coupled to said measuring member and controlled thereby for metering out a fuel quantity in proportion to the air flow rate in said induction tube;

e. means for providing a restoring force, which acts in opposition to the force provided by the air flow in the induction tube, to said measuring member including:

1. at least one pressure control valve controllable in dependence on at least one engine operating parameter;

2. a control pressure circuit having said control valve therein;

3. means for supplying pressurized fluid to said control pressure circuit; and 4. a control slide formed by the movable part of the fuel metering and quantity distribution valve assembly, said control slide being acted upon by the fluid in said control pressure circuit coupled to said measuring member for transmitting the restoring force thereto;

f. at least one movable heatable control element operable in dependence on temperature and at least one spring forming part of said at least one pressure control valve, said control element acting in opposition to the force of said spring when at least one operating temperature of the engine is below normal running temperature;

g. an electrical heating means for heating said control element;

h. valve means coupled to said pressure control circuit and responsive to movement of said butterfly valve for reducing the pressure of the pressurized fluid in said control circuit during engine warm-up phase when the engine is suddenly accelerated, wherein the volume of said control pressure circuit is adjustable, said means for reducing the pressure being coupled to said control pressure circuit for changing its volume.

6. A fuel injection system according to claim 5, wherein said control pressure circuit includes a piston mounted axially slidable in a pressure chamber, one end face of said piston being exposed to pressurized fluid in said control pressure circuit and its other end face being exposed to pressurized fluid in a relief circuit.

7. A fuel injection system according to claim 6, including a pair of stops for limiting axial displacement of said piston in both axial directions.

8. A fuel injection system according to claim 6, including an electromagnet for opening a relief valve in said relief circuit for reducing the pressure therein.

9. A fuel injection system according to claim 8, wherein said piston is positioned with its said one end face subjected to a force smaller than the force acting on its other face when said relief valve is closed.

10. A fuel injection system according to claim 9, wherein said control pressure circuit and said relief circuit are connected by two throttles and check valve.

11. A fuel injection system according to claim 5 further comprising: a pressure-sensitive jar within which there is mounted a diaphragm which separates a first chamber from a second chamber; and an air line interconnecting said first chamber with a point in said induction tube downstream from said throttle butterfly valve, wherein said means for reducing the pressure of the pressurized fluid in said control circuit includes a diaphragm bellows, the interior volume of which is in fluid communication with said control pressure circuit, one end of said diaphragm bellows being affixed to a wall of the pressure-sensitive jar, the other end of which being connected to the diaphragm which separates the first chamber within said jar from the second chamber within said jar, said first and second chambers being in fluid communication via a throttle aperture.

12. A fuel injection system according to claim 11, wherein said air line contains a valve which has a movable member in the form of an electrically heatable bimetallic spring for closing said air line after termination of the warm-up phase of engine operation.

* * * * *